US007472453B2

(12) United States Patent
Mersmann et al.

(10) Patent No.: US 7,472,453 B2
(45) Date of Patent: Jan. 6, 2009

(54) VACUUM CLEANER

(75) Inventors: Udo Mersmann, Guetersloh (DE); Michael Poetting, Borgholzhausen (DE); Arne Sauerland, Herford (DE); Heinz-Guenter Steinkoetter, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 124 days.

(21) Appl. No.: 11/569,276

(22) PCT Filed: Apr. 14, 2005

(86) PCT No.: PCT/EP2005/003936

§ 371 (c)(1),
(2), (4) Date: Nov. 17, 2006

(87) PCT Pub. No.: WO2005/112727

PCT Pub. Date: Dec. 1, 2005

(65) Prior Publication Data

US 2007/0220699 A1 Sep. 27, 2007

(30) Foreign Application Priority Data

May 17, 2004 (DE) ..... 10 2004 024 817
Nov. 17, 2004 (DE) ..... 10 2004 055 514

(51) Int. Cl.
*A47L 5/00* (2006.01)

(52) U.S. Cl. ..... 15/319; 15/327; 15/327.7; 15/412

(58) Field of Classification Search ..... 15/319, 15/327.2, 327.7, 347, 412; *A47L 5/00, 9/00*
See application file for complete search history.

(56) References Cited

U.S. PATENT DOCUMENTS

| | | | |
|---|---|---|---|
| 3,651,536 | A | 3/1972 | Bolzan, Jr. et al. |
| 3,781,460 | A | 12/1973 | Westergren et al. |
| 2007/0209153 | A1 | 9/2007 | Mersmann et al. |

FOREIGN PATENT DOCUMENTS

| | | |
|---|---|---|
| DE | 8432010 | 2/1985 |
| DE | 41 12 635 | 10/1992 |
| DE | 9312061 | 11/1993 |
| DE | 44 21 458 | 12/1995 |
| DE | 4421214 | 12/1995 |
| JP | 03 077514 | 4/1991 |
| JP | 11089771 | 4/1999 |
| JP | 2003204901 | 7/2003 |
| NL | 1 022 340 | 4/2003 |
| WO | 02/051296 | 7/2002 |
| WO | 03/028517 | 4/2003 |

*Primary Examiner*—David A Redding
(74) *Attorney, Agent, or Firm*—Darby & Darby

(57) ABSTRACT

A vacuum cleaner includes an appliance housing including a first housing section for a motor fan chamber and a second housing section for a dust collection chamber. Actuating elements for a cord winder device and an ON/OFF switch are disposed on an upper side of the motor fan chamber. A control element for the suction power control is disposed on the upper side of the motor fan chamber. A housing cover is pivotally mounted at a rear portion of the appliance housing via a plurality of hinge arms. The hinge arms cover at least a portion of the motor fan chamber and the actuating elements. The housing covering includes a cover section that covers the dust collection chamber.

18 Claims, 3 Drawing Sheets

VACUUM CLEANER

CROSS REFERENCE TO PRIOR APPLICATION

This is a U.S. national phase application under 35 U.S.C. §371 of International Patent Application No. PCT/EP2005/003936, filed Apr. 14, 2005, and claims benefit of German Patent Application Nos. 10 2004 024 817.6, filed May 17, 2004, and 10 2004 055 514.1, filed Nov. 17, 2004, which are incorporated by reference herein. The International Application was published in German on Dec. 1, 2005 as WO 2005/112727 A1 under PCT Article 21(2).

The present invention relates to a vacuum cleaner having an appliance housing which includes a housing section for a motor fan chamber and a housing section for a dust collection chamber; actuating elements for a cord winder device, for an ON/OFF switch, and a control element for the suction power control being arranged on the upper side of the motor fan chamber or on a covering disposed on said upper side, the vacuum cleaner further including a housing cover which is pivotally mounted on cover hinges and has a cover section which covers the dust collection chamber.

BACKGROUND

A vacuum cleaner of this type is described in DE 44 21 458 C2. The vacuum cleaner is a canister vacuum cleaner having a motor fan chamber which is located in the rear appliance housing and on the upper side of which are arranged actuating elements for a cord winder device, for an ON/OFF switch, and a control element for the suction power control. An exhaust or hygiene filter is provided in the exhaust path downstream of the motor fan chamber. The front portion of the appliance housing accommodates the dust collection chamber containing a replaceable dust filter bag. The dust collection chamber is covered by a housing cover which is pivotally mounted on the appliance housing and which also covers the exhaust filter located in the exhaust path. The housing cover is pivotally mounted on the housing portion of the motor fan chamber at the level of the exhaust filter. The actuating elements for the cord winder device, for an ON/OFF switch, and a control element for the suction power control are disposed behind the bearing of the cover. An appliance housing design of this type, where the housing cover is pivotally disposed in the transition region between the motor fan chamber and the dust collection chamber is well suited for large-sized canister vacuum cleaners. However, in vacuum cleaners of a smaller or more compact design, it is difficult to dispose a large-surface exhaust or hygiene filter under the housing cover due to the small space available.

SUMMARY

It is, therefore, an object of the present invention to arrange a bearing for the housing cover in a manner that allows a large-surface exhaust or hygiene filter to be disposed below the housing cover and which also allows for suitable arrangement of the actuating elements for the cord winder device, for an ON/OFF switch, and a control element for the suction power control when there is little space available.

In embodiment, the present invention provides a vacuum cleaner including: an appliance housing having a first housing section for a motor fan chamber and a second housing section for a dust collection chamber; at least one actuating element for at least one of a cord winder device and an ON/OFF switch, the at least one actuating element being disposed on an upper side of the motor fan chamber; a control element for the suction power control, the control element being disposed on the upper side of the motor fan chamber; and a housing cover pivotally mounted at a rear portion of the appliance housing via a plurality of hinge arms, the hinge arms being configured to cover at least a first portion of the motor fan chamber and at least a portion of the at least one actuating element, the housing covering including a cover section configured to cover the dust collection chamber.

BRIEF DESCRIPTION OF THE DRAWINGS

An exemplary embodiment of the present invention is shown in the drawings in a schematic way and will be described in more detail below. In the drawings.

DETAILED DESCRIPTION

One particular advantage that can be achieved with the present invention is that the housing cover section that covers the dust collection chamber and which also covers the exhaust or hygiene filter is pivotally mounted in the rear portion of the appliance housing via hinge arms. In this connection, the motor fan chamber, along with the actuating elements arranged thereon, is only partially covered by the hinge arms. The area that accommodates the user control element for the suction power control and which is located centrally between the actuating element for the cord winder and the ON/OFF switch is left open, i.e., is not covered by the hinge arms or the housing cover section. The hinge arms cover only the laterally disposed actuating elements for the actuator of the cord winder and for the ON/OFF switch. The ON/OFF switch, or the actuator for the cord winder, can each be actuated via switch buttons which are spring-mounted on the hinge arms and are brought into operative connection with the actuating element via a switch plunger when the housing cover is closed.

Figure 1:
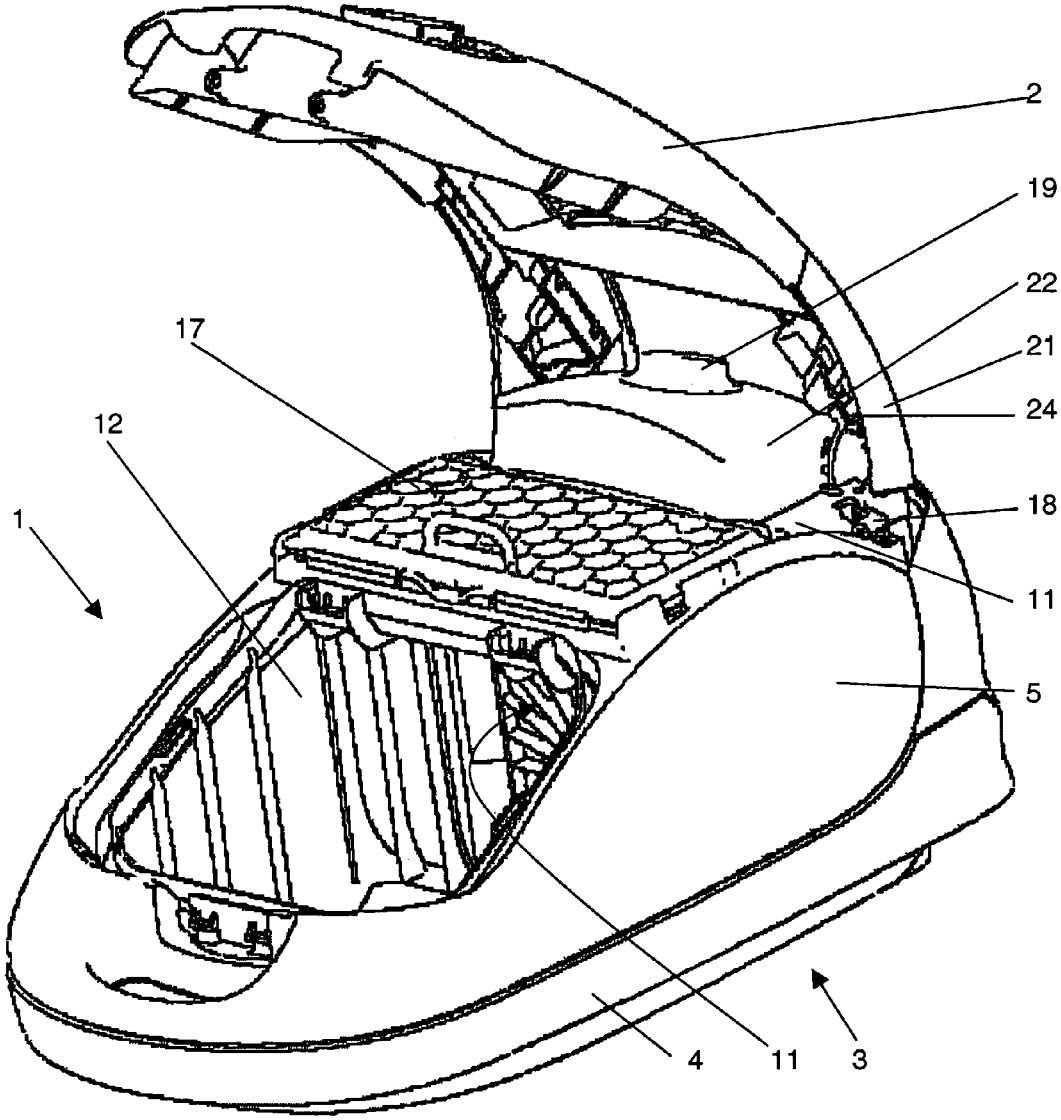
FIG. 1 is a view of a canister vacuum cleaner with the housing cover open.

In FIG. 1, a vacuum cleaner according to the present invention which, in the exemplary embodiment shown is a canister vacuum cleaner 1, is shown with housing cover 2 open. Appliance housing 3 of said vacuum cleaner includes a flat lower housing part 4 and a downwardly open upper housing part 5 placed thereon. Housing cover 2 is pivotally mounted to upper housing part 5 using two hinge arms 6 (see FIG. 2) in the rear portion of cover 2. Located on housing cover 2 is an adapter 7 for a suction hose. Housing cover 2 is further provided with an outlet 8 for the exhaust air. An air grille 9 is inserted into the outlet flush with the upper surface of housing cover 2.

Figure 2:
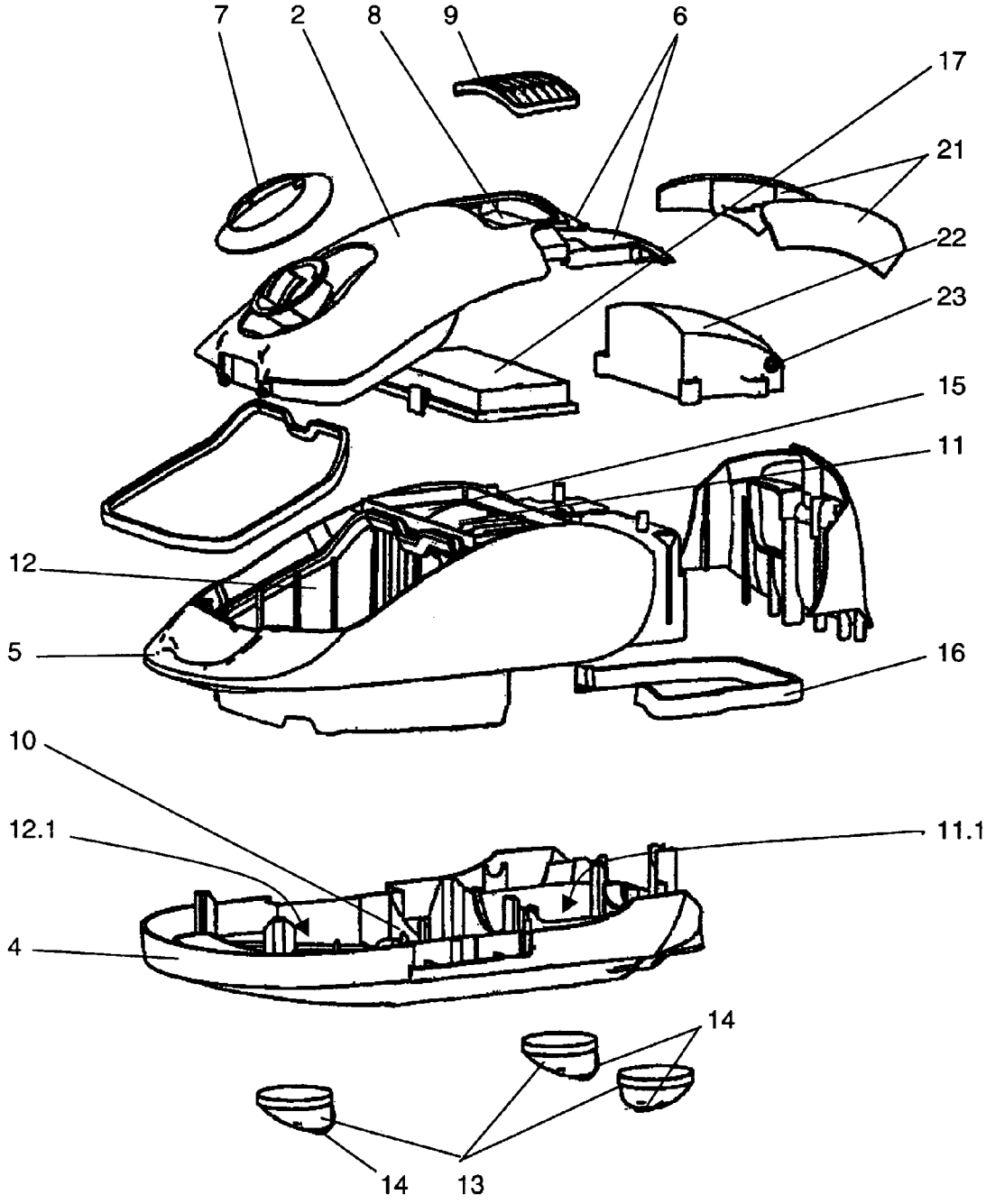
FIG. 2 is an exploded view of the multi-part appliance housing of the canister vacuum cleaner of FIG. 1.

The structural design of appliance housing 3 is illustrated in greater detail in an exploded view in FIG. 2. All housing parts are injection molded from plastic. Lower housing part 4 is configured as a flat, upwardly open receiving shell having a partition 10 that separates the bottom portion 11.1 for motor fan chamber 11 from the bottom portion 12.1 for dust collection chamber 12. Rotating skids 13 having rollers 14 are inserted at the bottom of the lower housing part. The assembly including lower housing part 4 and upper housing part 5 forms motor fan chamber 11 and dust collection chamber 12. In the area of motor fan chamber 11, upper housing part 5 is substantially closed upwardly, except for the outlet for the exhaust air (exhaust port 15), and is open downwardly. The upper housing part covers the motor and the fan and, together with the bottom portion and a profiled seal 16 placed therebetween, forms motor fan chamber 11. An exhaust or hygiene filter 17 is placed in the exhaust port.

The housing portion accommodating motor fan chamber 11 has provided on its upper side an actuating element for the cord winder device, the actuating element for an ON/OFF switch, and a control element 19 for the suction power control. In the illustrated exemplary embodiment, control element 19 takes the form of a rotary switch. Alternatively, it is also possible to use plus and minus buttons or a slide control.

Figure 3:
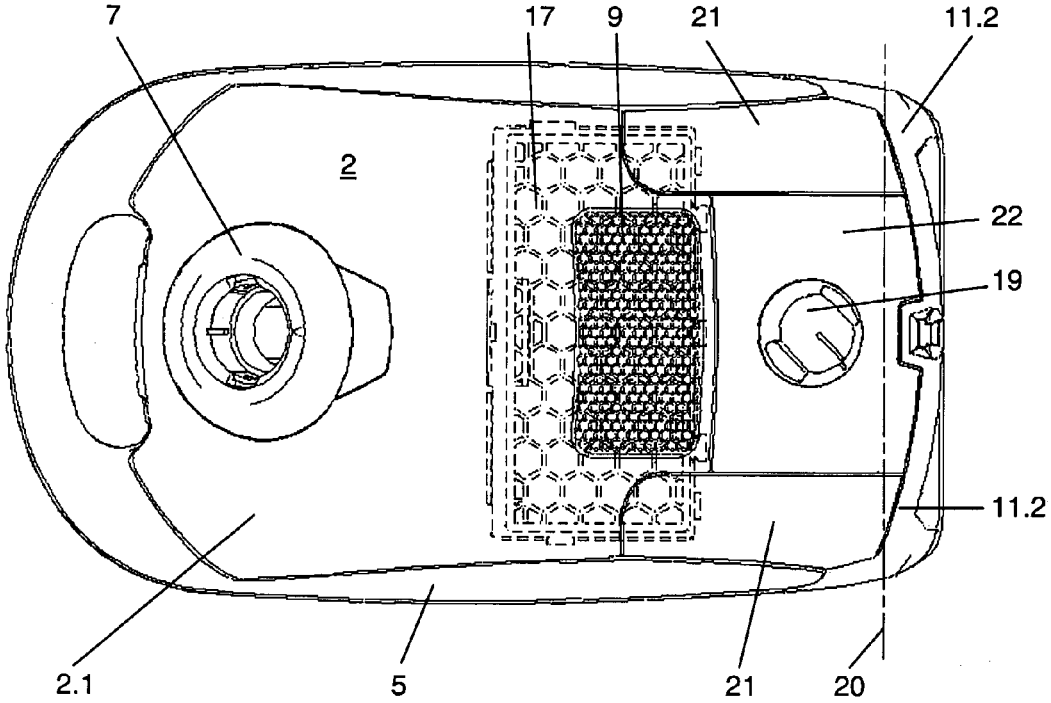
FIG. 3 is a top view of the canister vacuum cleaner.
Figure 4:
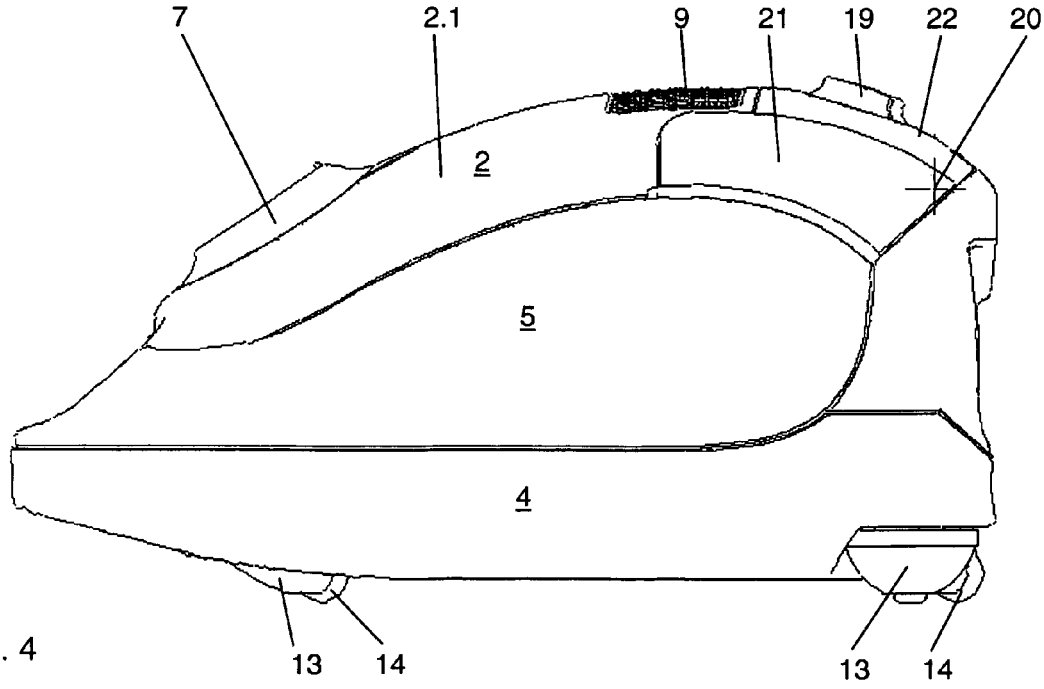
FIG. 4 is a side view of the canister vacuum cleaner.

As shown in FIGS. 3 and 4, housing cover 2 has a cover section 2.1 which, when in the closed position, covers and hermetically seals dust collection chamber 12. In the area of the exhaust port, motor fan chamber 11 is also covered or encased by this cover section 2.1 including the outlet 8. Cover section 2.1 is mounted in the rear portion of the appliance housing via the two hinge arms 6 at upper rear edge 11.2 of motor fan chamber 11 in such a manner that it can pivot about an axis of rotation 20. The hinge arms each cover the rear side region of the motor fan chamber. The area for the control element 19 for the suction power control is left open, whereby when housing cover 2 is closed, a nearly flush contour is formed with the control element for the suction power control, which control element is disposed on motor fan chamber 11 (see, in particular, FIG. 4). When housing cover 2 is closed, the laterally disposed actuating elements 18 for the cord winder and for the ON/OFF switch are located directly below hinge arms 6. In order to allow for user-controlled actuation, spring-mounted switch buttons 21 are disposed on hinge arms 6, each of said switch buttons being brought into operative connection with the actuating elements 18 via a switch plunger 24, respectively, when housing cover 2 is closed In the exemplary embodiment shown, the actuating elements are covered by a separate covering 22 to be attached to the upper housing part. Alternatively, the actuating elements may be disposed directly in the housing part covering motor fan chamber 11. The covering accommodates the actuating elements 18 and 19 for the components located therebelow (ON/OFF switch, suction power control). In the area of the actuator for the cord winder device, the covering is formed with a through-hole for a switch rod (not shown). Moreover, hinge points 23 for receiving hinge arms 6 are disposed on covering 22.

The present invention is not limited to the exemplary embodiment described herein; reference should be had to the appended claims.

What is claimed is:

1. A vacuum cleaner comprising:

an appliance housing including a first housing section for a motor fan chamber and a second housing section for a dust collection chamber;

at least one actuating element for at least one of a cord winder device and an ON/OFF switch, the at least one actuating element being disposed on an upper side of the motor fan chamber;

a control element for suction power control, the control element being disposed on the upper side of the motor fan chamber; and a housing cover pivotally mounted at a rear portion of the appliance housing via a plurality of hinge arms, the hinge arms being configured to cover at least a first portion of the motor fan chamber and at least a portion of the at least one actuating element, the housing covering including a cover section configured to cover the dust collection chamber.

2. The vacuum cleaner as recited in claim 1 wherein the cover section is configured to cover at least a second portion of the motor fan chamber.

3. The vacuum cleaner as recited in claim 1 wherein:

the at least one actuating element includes a first actuating element for the cord winder device and a second actuating element for the ON/OFF switch;

the hinge arms cover the first and second actuating elements; and at least a first of the hinge arms includes a spring-mounted switch button configured for operative connection with at least one of the first and second actuating elements via a switch plunger when the housing cover is in a closed position.

4. The vacuum cleaner as recited in claim 2 wherein:

the at least one actuating element includes a first actuating element for the cord winder device and a second actuating element for the ON/OFF switch;

the hinge arms cover the first and second actuating elements; and at least a first of the hinge arms includes a spring-mounted switch button configured for operative connection with at least one of the first and second actuating elements via a switch plunger when the housing cover is in a closed position.

5. The vacuum cleaner as recited in claim 1 wherein the control element is disposed centrally between the hinge arms.

6. The vacuum cleaner as recited in claim 2 wherein the control element is disposed centrally between the hinge arms.

7. The vacuum cleaner as recited in claim 3 wherein the control element is disposed centrally between the hinge arms.

8. The vacuum cleaner as recited in claim 4 wherein the control element is disposed centrally between the hinge arms.

9. A vacuum cleaner comprising:

an appliance housing including a first housing section for a motor fan chamber and a second housing section for a dust collection chamber;

a covering element disposed on an upper side of the motor fan chamber;

at least one actuating element for at least one of a cord winder device and an ON/OFF switch, the at least one actuating element being disposed on the covering element;

a control element for suction power control, the control element being disposed on the covering element; and a housing cover pivotally mounted at a rear portion of the appliance housing via a plurality of hinge arms, the hinge arms being configured to cover at least a first portion of the covering element and at least a portion of the at least one actuating element, the housing covering including a cover section configured to cover the dust collection chamber.

10. The vacuum cleaner as recited in claim 9 wherein the cover section is configured to cover at least a second portion of the motor fan chamber.

11. The vacuum cleaner as recited in claim 9 wherein:

the at least one actuating element includes a first actuating element for the cord winder device and a second actuating element for the ON/OFF switch;

the hinge arms cover the first and second actuating elements; and at least a first of the hinge arms includes a spring-mounted switch button configured for operative connection with at least one of the first and second actuating elements via a switch plunger when the housing cover is in a closed position.

12. The vacuum cleaner as recited in claim 10 wherein:

the at least one actuating element includes a first actuating element for the cord winder device and a second actuating element for the ON/OFF switch;

the hinge arms cover the first and second actuating elements; and at least a first of the hinge arms includes a spring-mounted switch button configured for operative connection with at least one of the first and second actuating elements via a switch plunger when the housing cover is in a closed position.

13. The vacuum cleaner as recited in claim 9 wherein the control element is disposed centrally between the hinge arms.

14. The vacuum cleaner as recited in claim 10 wherein the control element is disposed centrally between the hinge arms.

15. The vacuum cleaner as recited in claim 11 wherein the control element is disposed centrally between the hinge arms.

16. The vacuum cleaner as recited in claim 12 wherein the control element is disposed centrally between the hinge arms.

17. The vacuum cleaner as recited in claim 13 wherein the control element is disposed on the covering element.

18. The vacuum cleaner as recited in claim 17 wherein the covering element is configured to be disposable flush with the housing cover.

* * * * *